US010827250B2

(12) United States Patent
Levine et al.

(10) Patent No.: US 10,827,250 B2
(45) Date of Patent: Nov. 3, 2020

(54) AUDIO HEADSET HAVING ARM-TO-YOKE COUPLING FEATURES AND RELATED TECHNOLOGY

(71) Applicant: New Audio LLC, New York, NY (US)

(72) Inventors: Jonathan E. Levine, New York, NY (US); Drew Stone Briggs, Seattle, WA (US); Marten Andersson, Malmo (SE); Thomas C. Wilson, Brooklyn, NY (US)

(73) Assignee: New Audio LLC, New York, NY (US)

( * ) Notice: Subject to any disclaimer, the term of this patent is extended or adjusted under 35 U.S.C. 154(b) by 0 days.

(21) Appl. No.: 16/513,625

(22) Filed: Jul. 16, 2019

(65) Prior Publication Data

US 2020/0154191 A1 May 14, 2020

Related U.S. Application Data

(63) Continuation of application No. 14/821,643, filed on Aug. 7, 2015, now Pat. No. 10,405,079.

(51) Int. Cl.
*H04R 25/00* (2006.01)
*H04R 1/10* (2006.01)

(52) U.S. Cl.
CPC ..... *H04R 1/1033* (2013.01); *H04R 1/105* (2013.01); *H04R 1/1066* (2013.01); *H04R 2201/105* (2013.01)

(58) Field of Classification Search
CPC .... H04R 1/105; H04R 5/0335; H04R 1/1008; H04R 1/1066; H04R 1/1058; H04R 1/1075; H04R 1/1091; H04R 1/10; H04R 1/1025; H04R 1/1041; H04R 2201/103; H04R 2420/07; H04R 5/033; H04M 1/05
USPC ..... 381/379, 374, 378, 377, 370
See application file for complete search history.

(56) References Cited

U.S. PATENT DOCUMENTS 5,035,005 A * 7/1991 Hung ..... H04M 1/05 2/209
8,737,668 B1 * 5/2014 Blair ..... H04R 1/1066 381/378

* cited by examiner

*Primary Examiner* — Phylesha Dabney
(74) *Attorney, Agent, or Firm* — Holzer Patel Drennan

(57) ABSTRACT

A headset in accordance with an embodiment of the present technology includes a headpiece, an earpiece, a yoke rotatably connected to the earpiece, and an arm extending between the yoke and the headpiece. The yoke at least partially defines a channel including a constriction at which a transverse cross-sectional area of the channel is non-circular. The arm includes a foot at least partially disposed within the channel. The foot is shaped to move through the constriction or be blocked from moving through the constriction depending on a rotational position of the arm relative to the yoke. The headset further includes a plug at least partially disposed within the channel. The plug restricts rotation of the arm relative to the yoke and thereby prevents movement of the foot out of the channel and corresponding separation of the arm from the yoke.

14 Claims, 9 Drawing Sheets

AUDIO HEADSET HAVING ARM-TO-YOKE COUPLING FEATURES AND RELATED TECHNOLOGY

CROSS-REFERENCE TO RELATED APPLICATION INCORPORATED BY REFERENCE

This is a continuation of U.S. application Ser. No. 14/821,643, filed on Aug. 7, 2015, now U.S. Pat. No. 10,405,079, which is incorporated herein by reference in its entirety.

TECHNICAL FIELD

The present technology is related to audio headsets, which are wearable devices that convey sound to one or both of a user's ears.

BACKGROUND

Audio headsets are used for listening to music, playing video games, telephonic communication, noise cancelling, etc. The basic form of conventional audio headsets has remained fairly consistent for several decades. A typical dual-earpiece audio headset includes earpieces at respective ends of a headpiece shaped to bridge a user's head. Each of the earpieces includes a speaker that converts an audio signal into sound. The sound is generated in close proximity to a user's ear, so the sound can be fully audible to the user while still being inaudible or minimally audible to others around the user. This makes audio headsets ideal for use in public settings.

In one type of conventional audio headset, a headpiece is fixedly connected to associated earpieces. The length of the headpiece is adjustable, but there is little, if any, additional flexibility in the headset's overall form. This lack of flexibility can be associated with negative user experiences, such as when a user finds that the headset cannot be adjusted to achieve a sufficiently comfortable fit. Furthermore, to the extent that conventional headsets do include adjustable components, such components tend to compromise other headset characteristics, such as durability, compactness, ease of assembly, and compatibility with internally routed cords. For these and/or other reasons, there is a need for innovation in this field.

BRIEF DESCRIPTION OF THE DRAWINGS

Many aspects of the present technology can be better understood with reference to the following drawings. The components in the drawings are not necessarily to scale. Instead, emphasis is placed on illustrating clearly the principles of the present technology. For ease of reference, throughout this disclosure identical reference numbers may be used to identify identical, similar, or analogous components or features of more than one embodiment of the present technology.

DETAILED DESCRIPTION

Headsets and related devices, systems, and methods in accordance with embodiments of the present technology can at least partially address one or more problems associated with conventional technologies whether or not such problems are stated herein. For example, headsets in accordance with at least some embodiments of the present technology include innovative coupling features. A headset in accordance with a particular embodiment of the present technology includes a headpiece, an earpiece, a yoke rotatably connected to the earpiece, and an arm extending between the yoke and the headpiece. The yoke is rotatably connected to the earpiece at a durable and compact coupling that is convenient to assemble and that does not interfere with an internally routed cord extending between the headpiece and the earpiece. The headset includes a plug at the coupling that restricts rotation of the arm relative to the yoke to a suitable range. The respective geometries of the plug, the arm, and the yoke at the coupling cause this restriction of the rotation of the arm relative to the yoke to also securely interlock the arm and the yoke. In contrast to conventional headsets, this headset and other headsets in accordance with embodiments of the present technology can be more durable, more reliable, more compact, easier to assemble, and/or have other advantages.

Specific details of headsets and related devices, systems, and methods in accordance with several embodiments of the present technology are described herein with reference to FIGS. 1-17. Although headsets and related devices, systems, and methods may be disclosed herein primarily or entirely in the context of dual-earpiece, over-ear headsets, other contexts in addition to those disclosed herein are within the scope of the present technology. For example, features of described dual-earpiece, over-ear headsets can be implemented in the context of single-earpiece headsets, on-ear headsets, in-ear headsets, and earbud-type headsets, among other examples. Furthermore, it should understood, in general, that other systems, devices, and methods in addition to those disclosed herein are within the scope of the present technology. For example, systems, devices, and methods in accordance with embodiments of the present technology can have different and/or additional configurations, components, and procedures than those disclosed herein. Moreover, a person of ordinary skill in the art will understand that systems, devices, and methods in accordance with embodiments of the present technology can be without one or more of the configurations, components, and/or procedures disclosed herein without deviating from the present technology.

Figure 1:
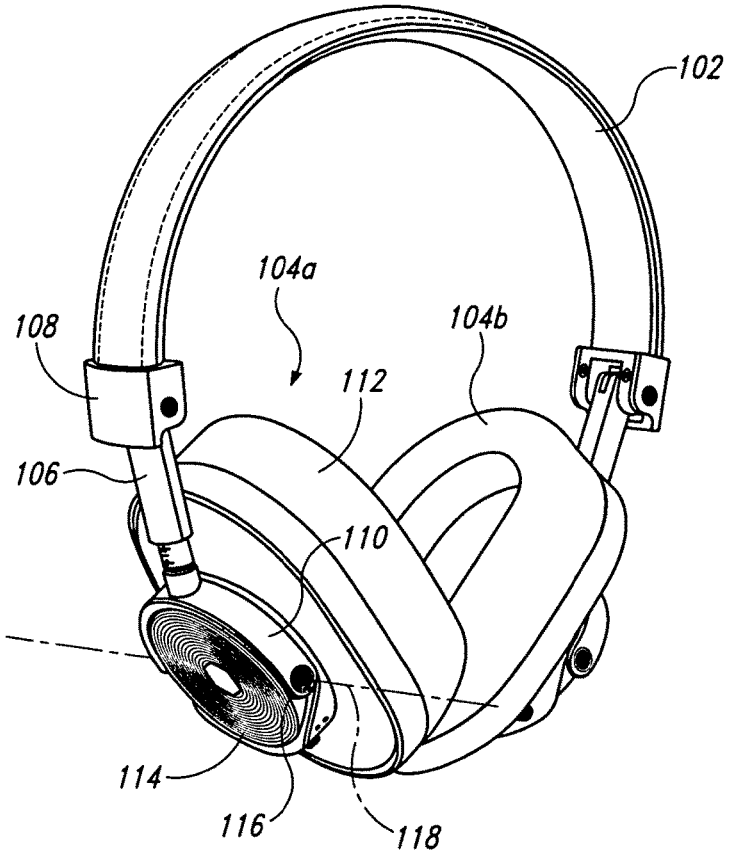
FIG. 1 is a perspective view of a headset in accordance with an embodiment of the present technology.

FIG. 1 is a perspective view of a headset 100 in accordance with an embodiment of the present technology. The headset 100 can include an arcuate headpiece 102 configured to fit over a user's head. The headset 100 can further include opposing earpieces 104 (individually identified as earpieces 104*a*, 104*b*) operably connected to the headpiece 102. Components of the headset 100 between the headpiece 102 and the earpiece 104*a* are further discussed herein with the understanding that the headset 100 can include similar corresponding components between the headpiece 102 and the earpiece 104*b*. As shown in FIG. 1, the headset 100 can include a telescoping arm 106 and a hinge 108 that connects the arm 106 to one end of the headpiece 102. The headset 100 can further include a yoke 110 rotatably connected to the earpiece 104*a*. The earpiece 104*a* can include an ear cover 112 and a disk-shaped speaker housing 114 at a back side of the ear cover 112. The yoke 110 can include joints 116 (one shown in FIG. 1) that rotatably couple the yoke 110 to the speaker housing 114 at opposite respective sides of the earpiece 104*a*. The earpiece 104*a* can be rotatable relative to the yoke 110 about a first axis 118 that extends through the joints 116.

Figure 2:
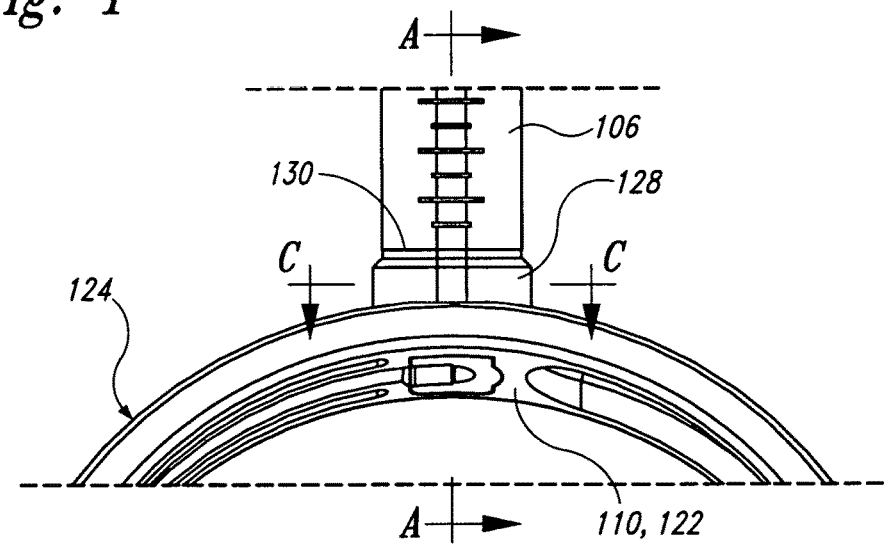
FIGS. 2 and 3 are a front profile view and a side profile view, respectively, of an arm, a yoke, and other associated components of the headset shown in FIG. 1.
Figure 3:
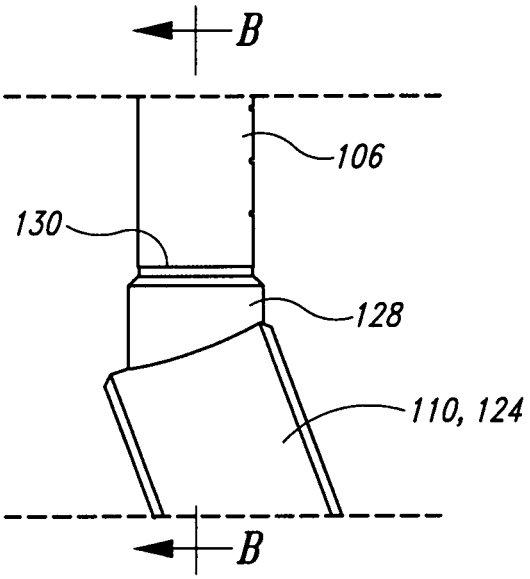
Figure 4:
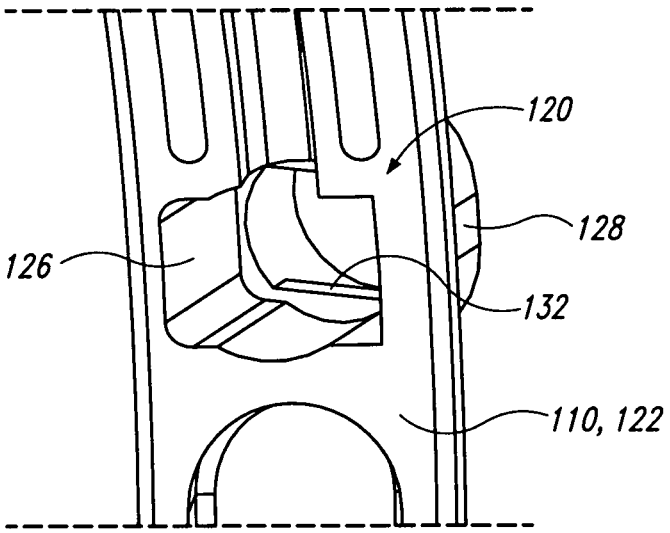
FIG. 4 is a perspective view of a channel at least partially defined by the yoke of the headset shown in FIG. 1.

FIGS. 2 and 3 are a front profile view and a side profile view, respectively, of the arm 106, the yoke 110, and associated components of the headset 100. FIG. 4 is a perspective view of a channel 120 at least partially defined by the yoke 110. With further reference to FIGS. 1-4 together, the yoke 110 can include a first side 122 facing toward the earpiece 104*a*, and an opposite second side 124 facing away from the earpiece 104*a*. The channel 120 can extend between the first and second sides 122, 124 of the yoke 110 and be positioned (e.g., centrally positioned) between the joints 116. Within the channel 120, the yoke 110 can at least partially define a pocket 126 that opens toward the earpiece 104*a* at the first side 122 of the yoke 110. The yoke 110 can include a neck 128 at which the second side 124 of the yoke 110 is elevated. The channel 120 can extend through the neck 128. At a rim of the neck 128, the headset 100 can include a bearing 129. Within the neck 128, the channel 120 can include a constriction 132. In at least some cases, a transverse cross-sectional area of the channel 120 is non-circular at the constriction 132. In these and other cases, the pocket 126 can be at a portion of the channel 120 between the constriction 132 and the first side 122 of the yoke 110.

Figure 5:
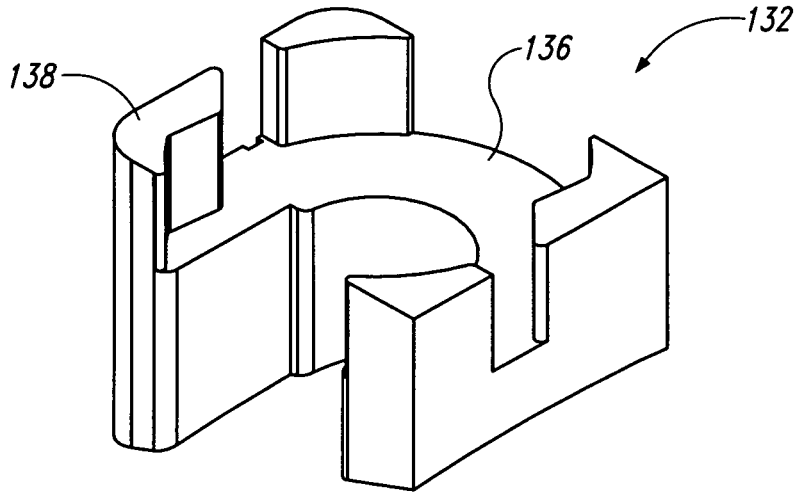
FIG. 5 is a perspective view of a plug of the headset shown in FIG. 1.

FIG. 5 is a perspective view of a plug 134 of the headset 100. When the headset 100 is assembled, the plug 134 can be at least partially disposed within the pocket 126. For example, with reference to FIGS. 1-5 together, the plug 134 can be shaped to fit snuggly within the pocket 126 such that a bottom surface of the plug 134 is flush with a portion of the first side 122 of the yoke 110 around the channel 120. The plug 134 can include a base 136 and a frame 138 operably connected to the base 136. In the illustrated embodiment, the plug 134 is wedge-shaped such that a top surface of the base 136 is horizontal when the arm 106 is vertical and the plug 134 is fully inserted into the pocket 126. In other embodiments, the plug 134 can have other suitable shapes.

Figure 6:
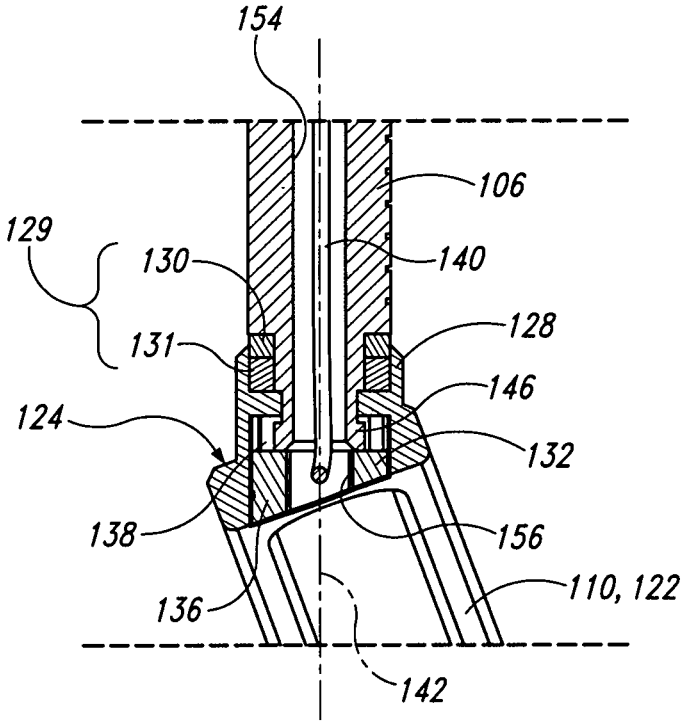
FIG. 6 is a cross-sectional side profile view of the arm, the yoke, and other associated components of the headset shown in FIG. 1 taken along the line A-A in FIG. 2.
Figure 7A:
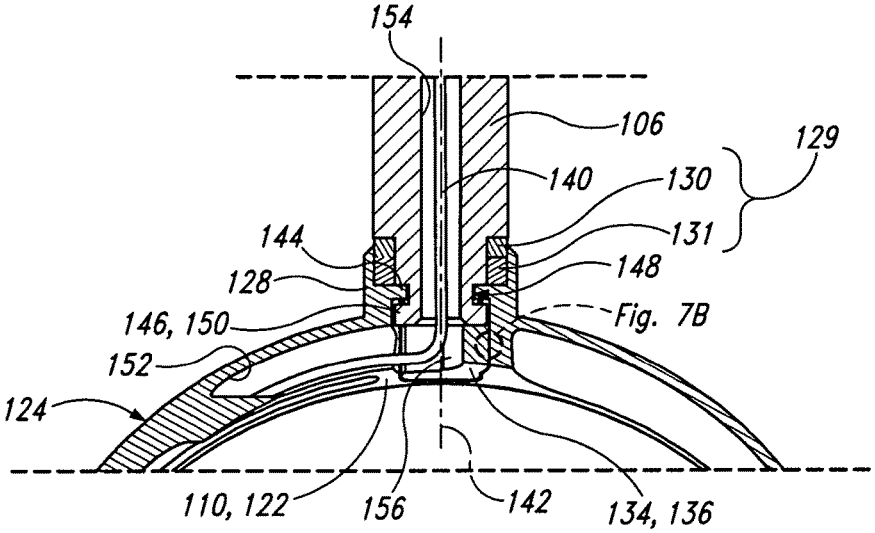
FIG. 7A is a cross-sectional front profile view of the arm, the yoke, and other associated components of the headset shown in FIG. 1 taken along the line B-B in FIG. 3.
Figure 7B:
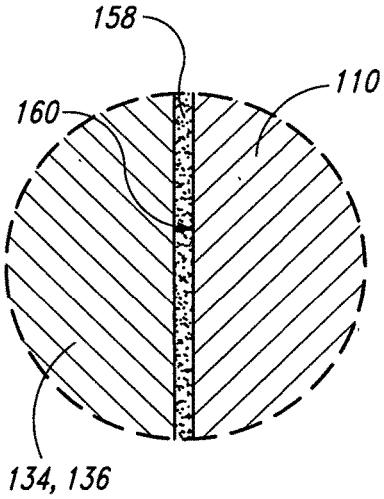
FIG. 7B is an enlarged view of a portion of FIG. 7A.

FIG. 6 is a cross-sectional side profile view of the arm 106, the yoke 110, and other associated components of the headset 100 taken along the line A-A in FIG. 2. FIG. 7A is a cross-sectional front profile view of the arm 106, the yoke 110, a cord 140 and other associated components of the headset 100 taken along the line B-B in FIG. 3. FIG. 7B is an enlarged view of a portion of FIG. 7A. With further reference to FIGS. 1-7B together, the arm 106 can extend between the yoke 110 and the headpiece 102 along a second axis 142 perpendicular to the first axis 118. The arm 106 can also be rotatable relative to the yoke 110 about the second axis 142. Thus, the earpiece 104*a* can be rotatable relative to the headpiece 102 both about the first axis 118 via the joints 116 and about the second axis 142 via a rotatable coupling between the arm 106 and the yoke 110.

Interaction between components of the arm 106, the yoke 110, and the plug 134 within the channel 120 can form the rotatable coupling between the arm 106 and the yoke 110. For example, the yoke 110 can include a pair of ribs 144 at the constriction 132. The arm 106 can include a foot 146 and an inset 148 set back from the foot 146. The arm 106 can be positioned relative to the yoke 110 such that the ribs 144 are at least partially disposed within the inset 148 and the foot 146 is at least partially disposed within the channel 120 at the pocket 126. The foot 146 can include a pair of flanges 150 axially captured between base 136 and the ribs 144. The bearing 129 can facilitate rotation between the arm 106 and the yoke 110. In the illustrated embodiment, the bearing 129 includes a first portion 130 having a first stiffness and a second portion 131 having a second stiffness less than that of the first portion 130. For example, the first portion 130 of the bearing 129 can be made of metal (e.g., copper or brass) and the second portion 131 of the bearing 129 can be made of a resilient polymer (e.g., silicone). Due to its greater stiffness, the first portion 130 of the bearing 129 can enhance the durability of the junction between the arm 106 and the yoke 110. In contrast, due to its lesser stiffness, the second portion 131 of the bearing 129 can be well suited for forming a snug connection between the arm 106 and the yoke 110, thereby facilitating smooth operation of the junction. In other embodiments, the bearing 129 can have other suitable forms.

The cord 140 can extend between the headpiece 102 and the earpiece 104*a* through the arm 106, the plug 134, and the yoke 110. The yoke 110 can at least partially define a first passage 152 extending between the channel 120 at the pocket 126 and one of the joints 116. Similarly, the arm 106 can at least partially define a second passage 154 extending between the headpiece 102 and the yoke 110. The base 136 of the plug 134 can at least partially define and elbow 156 through which the first and second passages 152, 154 are connected. The pocket 126 can be shaped to rotationally register the plug 134 at a suitable position for establishing this connection. The cord 140 can extend between headpiece 102 and the earpiece 104*a* through the first passage 152, through the second passage 154, and through the elbow 156. The cord 140 is not shown in FIG. 2 for clarity of illustration.

As shown in FIG. 7B, in the illustrated embodiment, the headset 100 includes adhesive 158 disposed within the channel 120 between the plug 134 and a sidewall 160 of the channel 120. The adhesive 158 can cause the plug 134 to be fixedly disposed within the channel 120 at the pocket 126. In other embodiments, the plug 134 can be fixedly disposed within the channel 120 in another suitable manner. In still other embodiments, the plug 134 can be non-fixedly (e.g., releasably) disposed within the channel 120. When the plug 134 is fixedly disposed within the channel 120, many alternatives to use of the adhesive 158 for fixedly securing the plug 134 within the channel 120 are possible. For example, the plug 134 can be pinned, screwed, or clamped in place within the channel 120. Alternatively or in addition, the plug 134 can be welded (e.g., laser welded) in place within the channel 120. For example, laser welds can be formed at respective spaced-apart locations along a seam between the plug 134 and the sidewall 160 of the channel 120. Welding the plug 134 in place within the channel 120 can be useful, for example, when adhesive is expected to migrate into contact with the foot 146 and thereby potentially interfere with rotation of the yoke 110 relative to the arm 106. Welded bonds also tend to be more durable, secure, and consistent than adhesive bonds.

Figure 8:
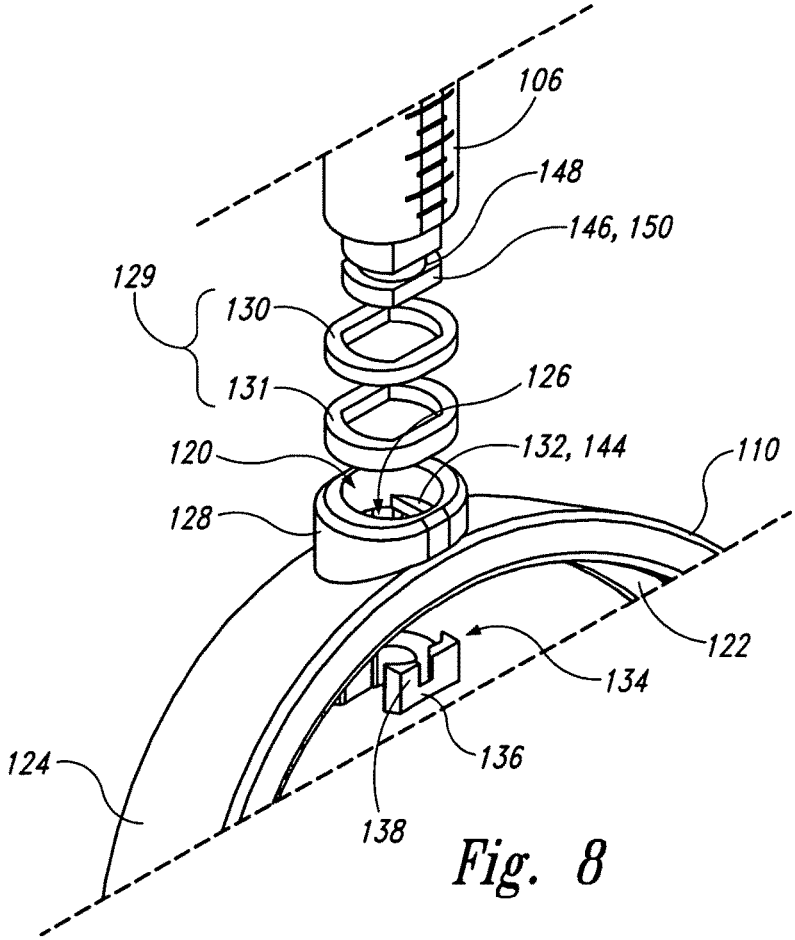
FIG. 8 is an exploded perspective view of the arm, the yoke, and other associated components of the headset shown in FIG. 1.

FIG. 8 is an exploded perspective view of the arm 106, the yoke 110, and associated components of the headset 100. With further reference to FIGS. 1-8 together, the foot 146 can be shaped to move through the constriction 132 when the arm 106 has a first rotational position about the second axis 142 relative to the yoke 110 and to be blocked from moving through constriction 132 when the arm 106 has any rotational position about the second axis 142 relative to the yoke 110 within a range of rotational positions not including the first rotational position. For example, the foot 146 can have a shape that corresponds to the non-circular transverse cross-sectional area of channel 120 at the constriction 132 such that when the foot 146 and the constriction 132 are aligned, the foot 146 can move axially through the constriction 132, and when the foot 146 and the constriction 132 are not aligned, the foot 146 cannot move axially through the constriction 132. In at least some embodiments, the range of rotational positions at which the foot 146 is blocked from moving axially through the constriction 132 extends at least 280 degrees about the second axis 142.

Figure 9:
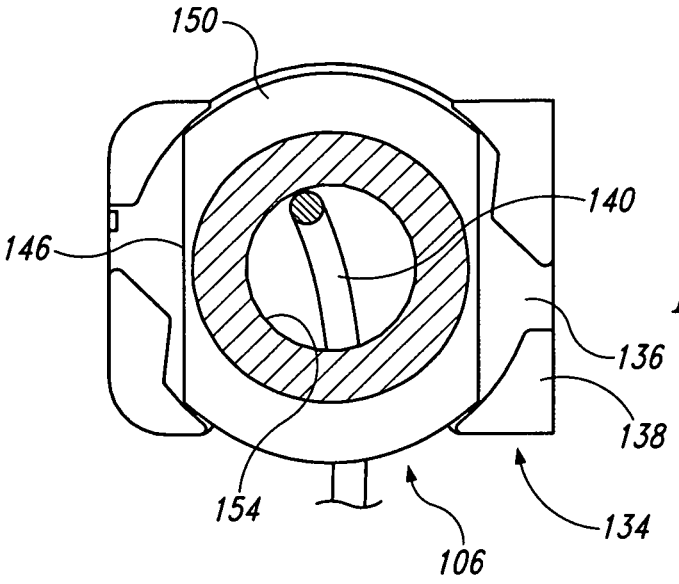
FIG. 9 is a cross-sectional top plan view of the arm, the plug, and a cord of the headset shown in FIG. 1 taken along the line C-C in FIG. 2.

When the foot 146 is in the pocket 126 and the plug 134 is absent from the pocket 126, the arm 106 can be freely rotatable about the second axis 142 relative to the yoke 110. The plug 134, when installed, can restrict rotation of the arm 106 about the second axis 142 relative to the yoke 110 to a subrange of the range of rotational positions at which the foot 146 is blocked from moving through the constriction 132. Within the limits of the subrange, the arm 106 can be freely rotatable about the second axis 142. Thus, the plug 134 can prevent movement of the foot 146 out of the channel 120 and corresponding separation of the arm 106 from the yoke 110 while still allowing the arm 106 to have some rotational play relative to the yoke 110. FIG. 9 is a cross-sectional top plan view of the arm 106, the plug 134, and the cord 140 taken along the line C-C in FIG. 2. With reference to FIGS. 5 and 9 together, the plug 134 can be rotatably disposed within the pocket 126 while also being rotationally captured within the frame 138 and axially captured between base 136 and the constriction 132. The respective shapes of the foot 146 and the frame 138 can define the subrange within which the arm 106 is free to rotate. In at least some embodiments, the subrange extends at least 10 degrees about the second axis 142. In addition or alternatively, the subrange can extend not more than 100 degrees about the second axis 142.

Figure 10:
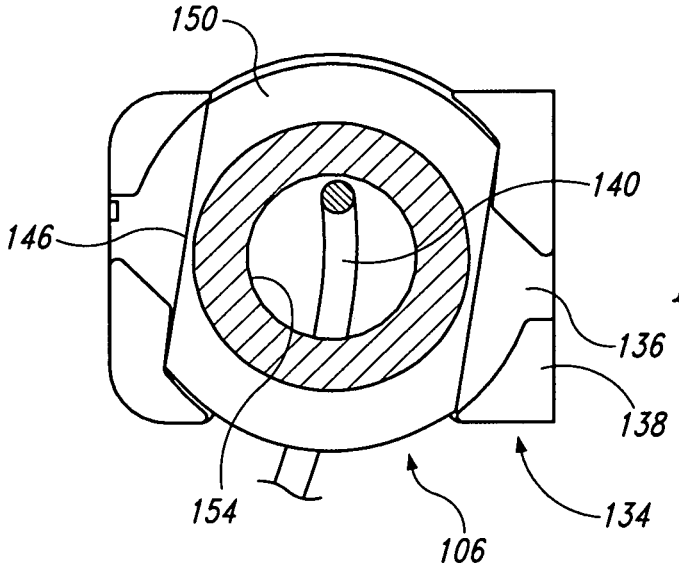
FIGS. 10 and 11 are cross-sectional top plan views of the arm, the plug, and the cord of the headset shown in FIG. 1 taken along the line C-C in FIG. 2 with the arm rotated to different respective positions relative to the plug about an axis parallel to the arm.
Figure 11:
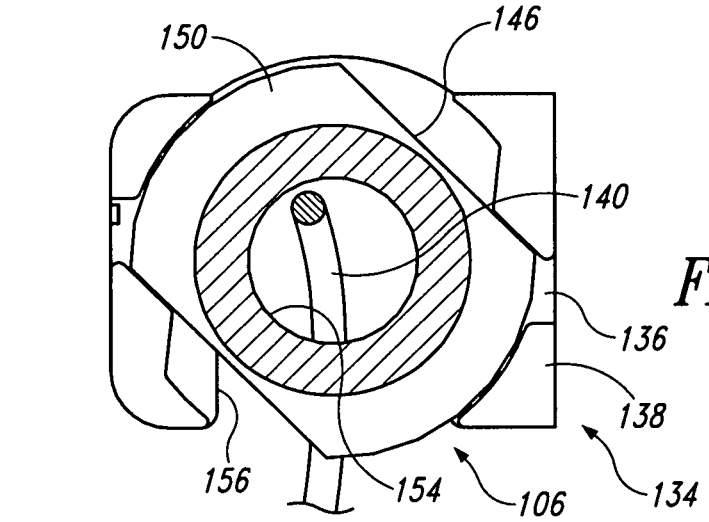

FIGS. 10 and 11 are cross-sectional top plan views of the arm 106, the plug 134, and the cord 140 with the arm 106 rotated to different respective positions relative to the plug 134 about the second axis 142. In particular, FIG. 10 shows the arm 106 rotated in a first circumferential direction relative to the first rotational position to a first limit of the subrange. Similarly, FIG. 11 shows the arm 106 rotated in an opposite second circumferential direction relative to the first rotational position to an opposite second limit of the subrange. As shown in FIG. 10, in the illustrated embodiment, the subrange extends approximately 10 degrees about the second axis 142 in the first circumferential direction relative to the first rotational position. In at least some embodiments, the subrange is asymmetrical relative to the first rotational position. As shown in FIG. 11, in the illustrated embodiment, the subrange extends approximately 45 degrees about the second axis 142 in the second circumferential direction relative to the first rotational position to the second limit. In other embodiments, the subrange can have other suitable limits. For example, the subrange can extend another suitable amount not more than 20 degrees about the second axis 142 in the first circumferential direction relative to the first rotational position. In these and other embodiments, the subrange can extend another suitable amount at least 30 degrees about the second axis 142 in the second circumferential direction relative to the first rotational position.

Features of the coupling between the arm 106 and the yoke 110 can cause the earpiece 104*a* to be advantageously maneuverable. This maneuverability can be useful for one or more purposes, such as fitting the headset 100, storage of the headset 100, and briefly disengaging the earpiece 104*a* during use of the headset 100. Furthermore, the coupling between the arm 106 and the yoke 110 can cause the earpiece 104*a* to have this maneuverability without unduly compromising one or more other desirable attributes of the headset 100, such as durability, reliability, compactness, and ease of assembly.

Figure 12:
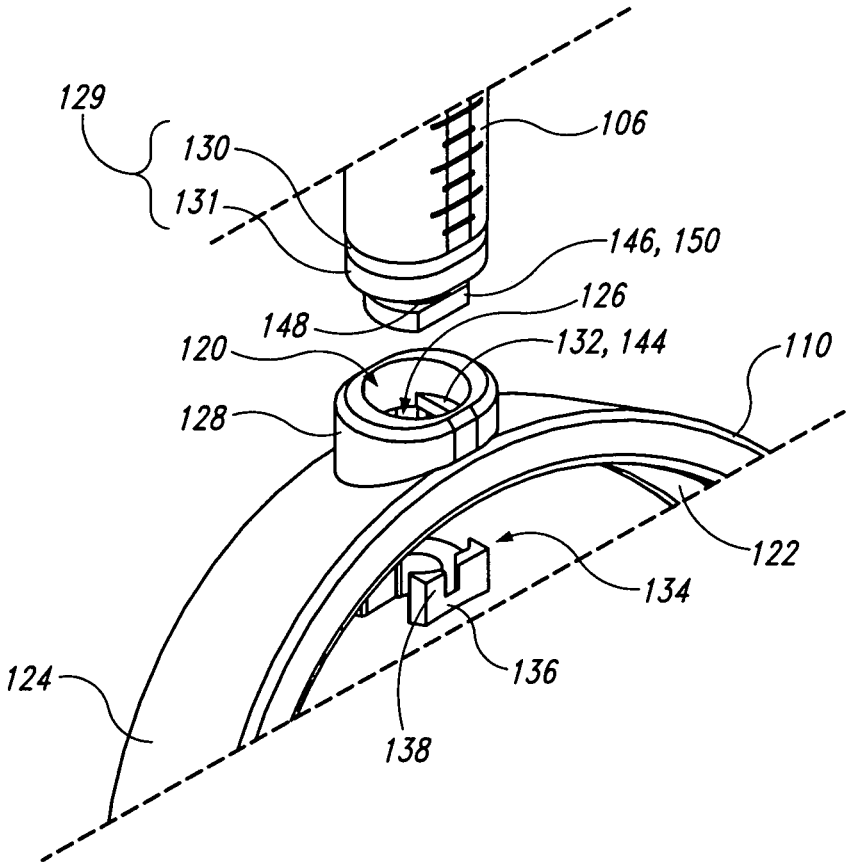
FIGS. 12-16 are perspective views of the arm, the yoke, and other associated components of the headset shown in FIG. 1 at different respective stages during assembly of the headset.
Figure 13:
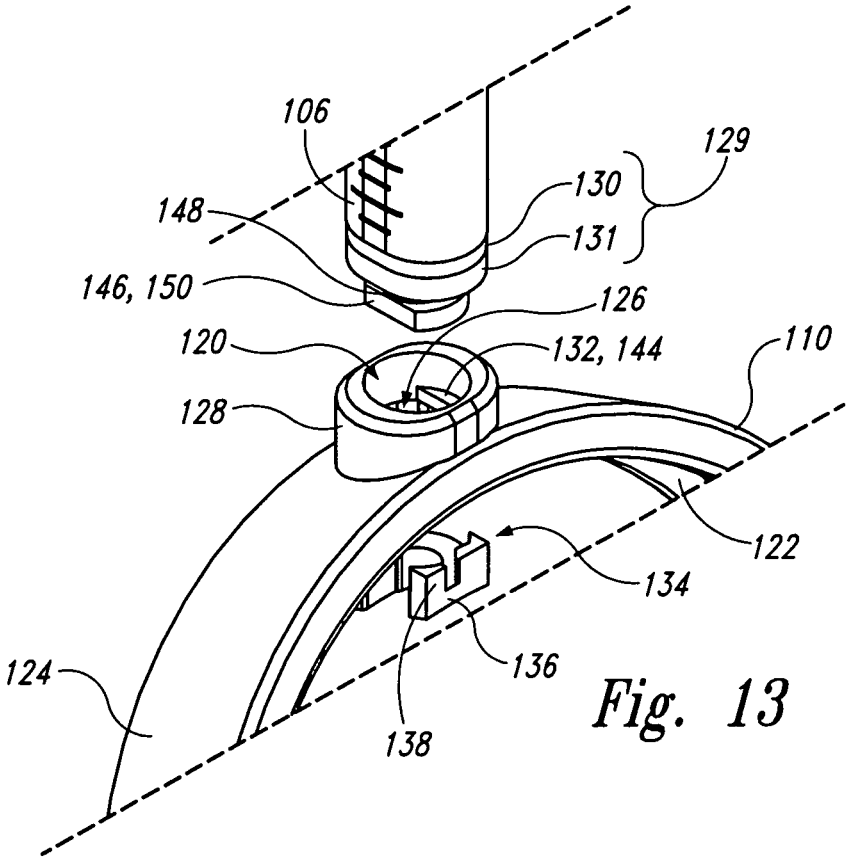
Figure 14:
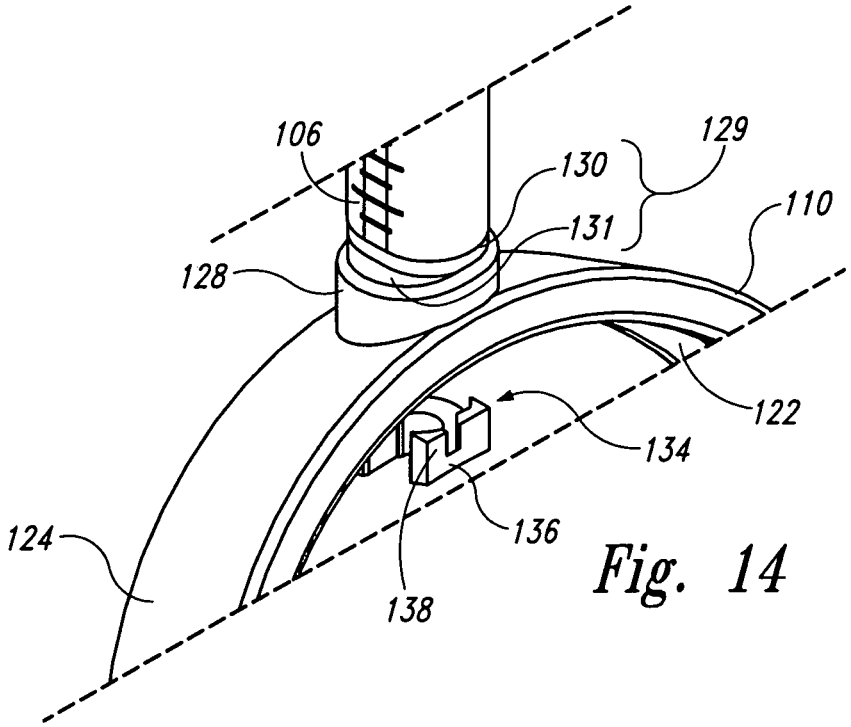
Figure 15:
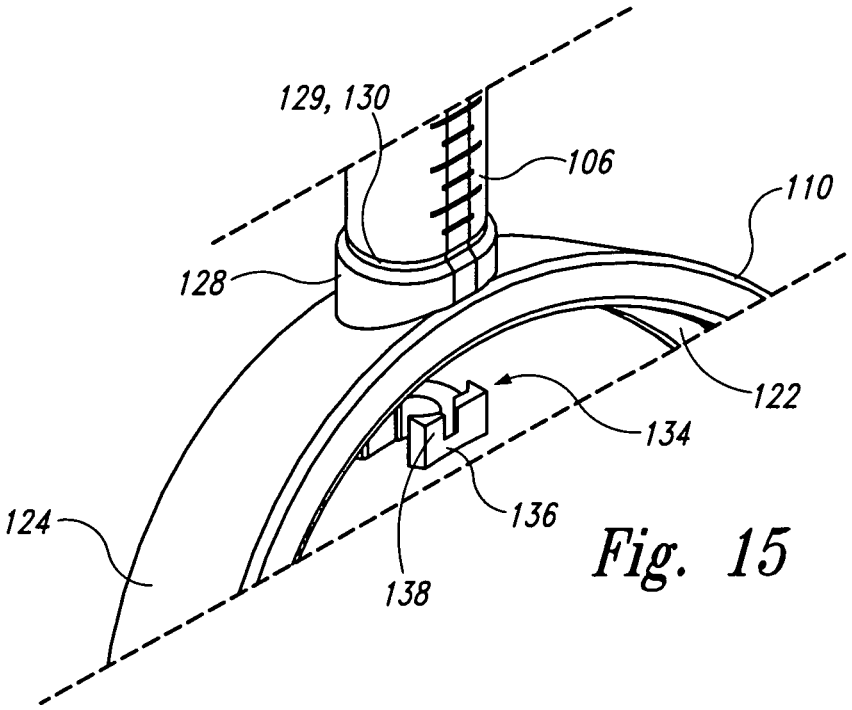

FIGS. 12-16 are perspective views of the arm 106, the yoke 110, and other associated components of the headset 100 at different respective stages during assembly of the headset 100. FIG. 17 is a flow chart illustrating a method 200 for making the headset 100 in accordance with an embodiment of the present technology. With reference to FIGS. 1-17 together, the method 200 can include connecting the bearing 129 to the arm 106 (FIG. 12 and block 202 of FIG. 17). Next, the method 200 can include causing the arm 106 to have the first rotational position about the second axis 142 (FIG. 6) relative to the yoke 110 (FIG. 13 and block 204 of FIG. 17). While the arm 106 has the first rotational position, the method 200 can include moving the arm 106 along the second axis 142 in a first direction toward the yoke 110 and/or moving the yoke 110 along the second axis 142 in second direction opposite to the first direction toward the arm 106 (FIG. 14 and block 206 of FIG. 17). In conjunction with this movement, the method 200 can include causing the foot 146 to move into the channel 120 and through the constriction 132 (block 208). Next, the method 200 can include rotating the arm 106 about the second axis 142 relative to yoke 110 and/or rotating the yoke 110 about second axis 142 relative to arm 106 to cause the arm 106 to have a second rotational position about the second axis 142 relative to the yoke 110 (FIG. 15 and block 210 of FIG. 17). The second rotational position can be within the range of rotational positions at which the foot 146 is blocked from moving through constriction 132. In conjunction with this rotation, the method 200 can include causing the ribs 144 to be slidably disposed within the inset 148.

Figure 16:
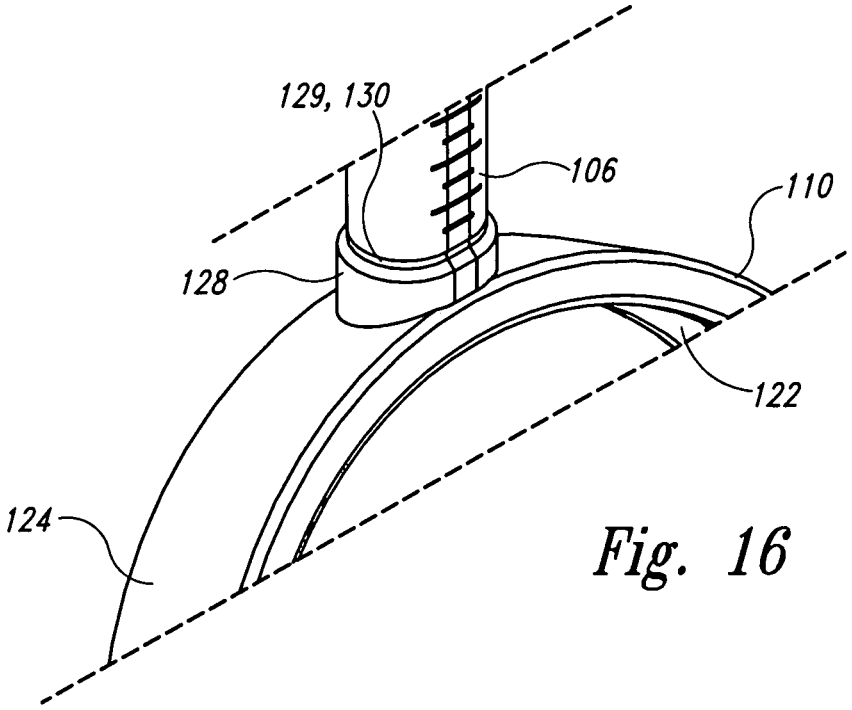
Figure 17:
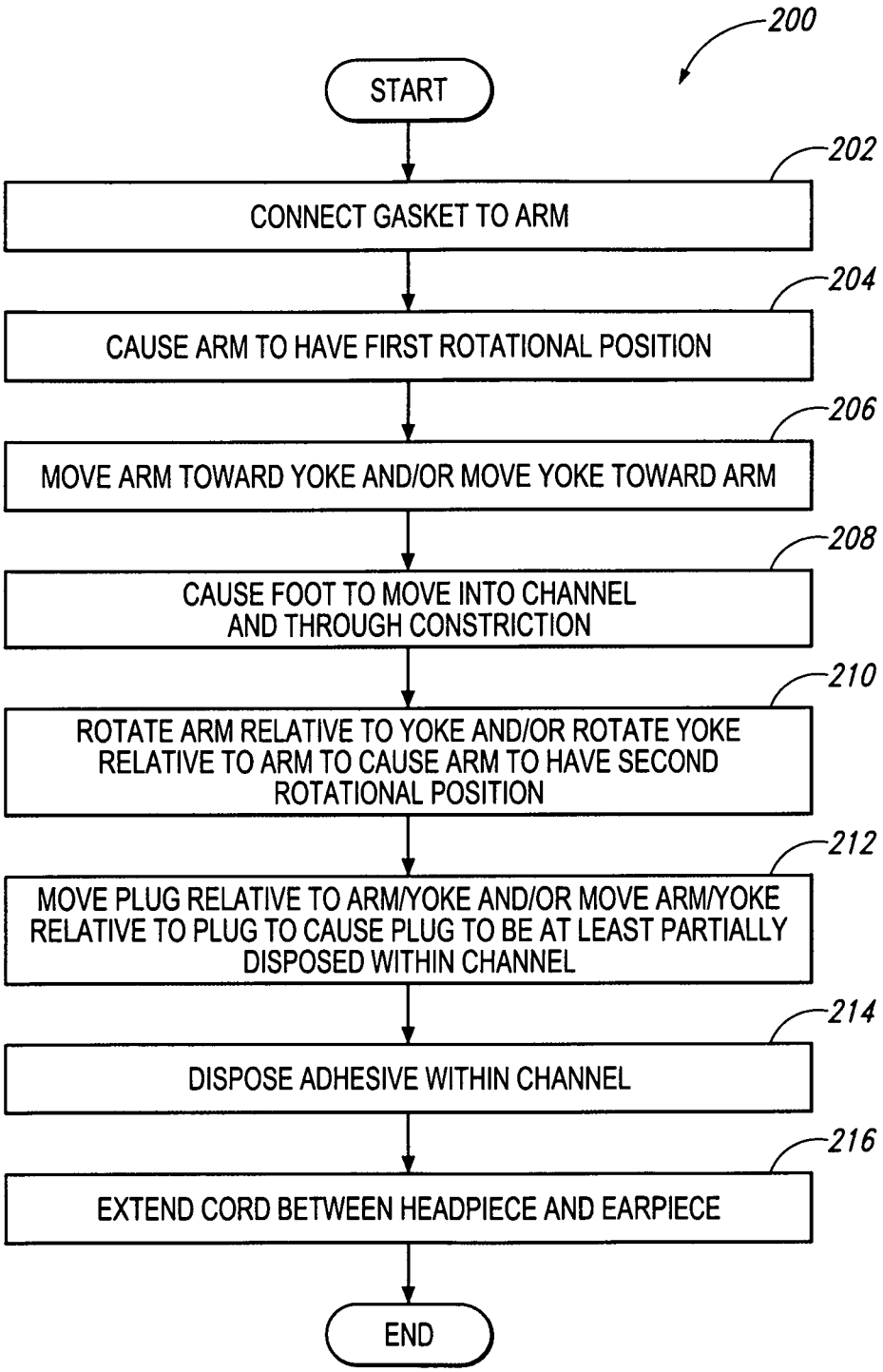
FIG. 17 is a flow chart illustrating a method for making the headset shown in FIG. 1 in accordance with an embodiment of the present technology.

The method 200 can further include moving the plug 134 relative to the arm 106 and the yoke 110 and/or moving the arm 106 and the yoke 110 relative to the plug 134 to cause the plug 134 to be at least partially disposed within the channel 120 (FIG. 16 and block 212 of FIG. 17). In conjunction with this movement, the method 200 can include rotationally registering the plug 134. Furthermore, the method 200 can include restricting rotation of the arm 106 about the second axis 142 relative to the yoke 110 such that the plug 134 prevents movement of the foot 146 out of the channel 120 and corresponding separation of the arm 106 from the yoke 110. When the plug 134 is at least partially disposed within the channel 120 or at another suitable time, the method 200 can include disposing the adhesive 158 within the channel 120 between the plug 134 and the sidewall 160 of the channel 120 (block 214). For example, the method 200 can include using a narrow syringe to inject the adhesive 158 into a gap between the plug 134 and the sidewall 160 of the channel 120. Alternatively or in addition, the method 200 can include welding (e.g., laser welding) the plug 134 to the sidewall 160 of the channel 120. The method 200 can further include extending the cord 140 between the headpiece 102 and the earpiece 104*a* through the arm 106, the plug 134, and the yoke 110 (block 216). For example, the method 200 can include extending the cord 140 between the headpiece 102 and the earpiece 104*a* through the first passage 152, through the second passage 154, and through the elbow 156.

This disclosure is not intended to be exhaustive or to limit the present technology to the precise forms disclosed herein. Although specific embodiments are disclosed herein for illustrative purposes, various equivalent modifications are possible without deviating from the present technology, as those of ordinary skill in the relevant art will recognize. In some cases, well-known structures and functions have not been shown and/or described in detail to avoid unnecessarily obscuring the description of the embodiments of the present technology. Although steps of methods may be presented herein in a particular order, in alternative embodiments the steps may have another suitable order. Similarly, certain aspects of the present technology disclosed in the context of particular embodiments can be combined or eliminated in other embodiments. Furthermore, while advantages associated with certain embodiments may have been disclosed in the context of those embodiments, other embodiments may also exhibit such advantages, and not all embodiments need necessarily exhibit such advantages or other advantages disclosed herein to fall within the scope of the present technology.

Throughout this disclosure, the singular terms "a," "an," and "the" include plural referents unless the context clearly indicates otherwise. Similarly, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the terms "comprising" and the like are used throughout this disclosure to mean including at least the recited feature(s) such that any greater number of the same feature(s) and/or one or more additional types of features are not precluded. Directional terms, such as "upper," "lower," "front," "back," "vertical," and "horizontal," may be used herein to express and clarify the relationship between various elements. It should be understood that such terms do not denote absolute orientation. Reference herein to "one embodiment," "an embodiment," or similar formulations means that a particular feature, structure, operation, or characteristic described in connection with the embodiment can be included in at least one embodiment of the present technology. Thus, the appearances of such phrases or formulations herein are not necessarily all referring to the same embodiment. Furthermore, various particular features, structures, operations, or characteristics may be combined in any suitable manner in one or more embodiments of the present technology.

We claim:

1. A yoke-to-arm connection mechanism for a headset, comprising:

an arcuate yoke comprising a neck portion extending away from the arcuate yoke, wherein the neck portion comprises a channel extending therethrough, and the channel includes a constriction at which a transverse cross-sectional area of the channel is non-circular and has a first longitudinal axis; and a plug configured to be disposed within the passage below the constriction, wherein the plug comprises:

a base having a top surface and a bottom surface opposite the top surface; and a frame operably connected to the base and extending away from the top surface of the base around at least a portion of the periphery of the base to thereby define a recess having a transverse cross-sectional area, wherein the transverse cross-sectional area of the recess is non-circular and has a second longitudinal axis;

wherein the plug is disposed in the channel such that the second longitudinal axis is offset from the first longitudinal axis.

2. The yoke-to-arm connection mechanism of claim 1, wherein the transverse cross-sectional area of the recess is shaped to allow for a range of rotation of a foot of an arm disposed therein, but prevent rotation of the foot of the arm to a rotational position wherein the foot of the arm can pass through the constriction in the neck of the arcuate yoke.

3. The yoke-to-arm connection mechanism of claim 2, wherein the range of rotation is not more than 100 degrees.

4. The yoke-to-arm mechanism of claim 2, wherein the range of rotation is not more than 20 degrees in a first circumferential direction from a first position and not more than 30 degrees in a second circumferential direction opposite the first circumferential direction from the first position.

5. The yoke-to-arm connection mechanism of claim 1, wherein the constriction comprises ribs extending from opposite sides of the channel.

6. The yoke-to-arm connection mechanism of claim 1, further comprising adhesive and/or a weld between the plug and a sidewall of the channel.

7. The yoke-to-arm connection mechanism of claim 1, wherein the transverse cross-sectional shape of the portion of the channel in which the plug is disposed conforms to the shape of the plug so as to prevent rotation of the plug once disposed in the channel.

8. The yoke-to-arm connection mechanism of claim 1, wherein the first longitudinal axis is offset from the second longitudinal axis by about 90 degrees.

9. The yoke-to-arm connection mechanism of claim 1, wherein the base includes a passage extending from the top surface to the bottom surface and configured for a cord to pass therethrough.

10. The yoke-to-arm connection mechanism of claim 1, wherein the base includes a an elbow passage extending from the top surface to a side wall of the base.

11. The yoke-to-arm connection mechanism of claim 1, further comprising:

a bearing configured to be disposed in the channel about the constriction.

12. The yoke-to-arm connection mechanism of claim 11, wherein the bearing comprises:

a first annular bearing portion made from a material having a first stiffness; and a second annular bearing portion made from a material having a second stiffness, the second stiffness being less than the first stiffness;

wherein the first annular bearing portion is stacked on top of the second annular bearing portion when disposed within the channel.

13. The yoke-to-arm connection mechanism of claim 12, wherein the first annular bearing portion is made from a metal and the second annular bearing portion is made from a resilient polymer.

14. The yoke-to-arm connection mechanism of claim 1, wherein the top surface of the base of the plug is perpendicular to a longitudinal axis of the channel when disposed in the channel and the bottom surface of the base of the plug is at an angle of less than 90 degrees to the longitudinal axis of the channel.

* * * * *